US008882545B2

(12) United States Patent
Vroom et al.

(10) Patent No.: US 8,882,545 B2
(45) Date of Patent: Nov. 11, 2014

(54) DOCKING STATION FOR AN ELECTRONIC DEVICE WITH IMPROVED ELECTRICAL INTERFACE

(71) Applicant: Henge Docks LLC, Arlington, VA (US)

(72) Inventors: Matthew Leigh Vroom, San Francisco, CA (US); Benjamin Edwards Maskell, Arlington, VA (US)

(73) Assignee: Henge Docks LLC, Arlington, VA (US)

( * ) Notice: Subject to any disclaimer, the term of this patent is extended or adjusted under 35 U.S.C. 154(b) by 0 days.

(21) Appl. No.: 14/052,753

(22) Filed: Oct. 13, 2013

(65) Prior Publication Data

US 2014/0038450 A1 Feb. 6, 2014

Related U.S. Application Data

(60) Continuation of application No. 13/945,855, filed on Jul. 18, 2013, now Pat. No. 8,585,443, which is a division of application No. 13/306,960, filed on Nov. 29, 2011, now Pat. No. 8,512,079, which is a continuation of application No. 13/306,956, filed on Nov. 29, 2011, now Pat. No. 8,419,479, which is a continuation-in-part of application No. 12/562,121, filed on Sep. 17, 2009, now Pat. No. 8,105,108.

(51) Int. Cl.

| | |
|---|---|
| ***H01R 25/00*** | (2006.01) |
| ***H01R 13/518*** | (2006.01) |
| ***H01R 13/629*** | (2006.01) |
| ***H01R 27/02*** | (2006.01) |
| ***H01R 13/62*** | (2006.01) |
| ***H01R 13/60*** | (2006.01) |
| ***H01R 13/512*** | (2006.01) |
| ***H01R 13/73*** | (2006.01) |

(52) U.S. Cl.

CPC ..... *H01R 13/629* (2013.01); *H01R 13/518* (2013.01); *H01R 27/02* (2013.01); *H01R 13/62* (2013.01); *H01R 13/60* (2013.01); *H01R 13/512* (2013.01); *H01R 13/73* (2013.01)

USPC ..... 439/639

(58) Field of Classification Search

USPC ..... 361/679.41–679.45, 679.55–679.58; 439/639, 540.1

See application file for complete search history.

(56) References Cited

U.S. PATENT DOCUMENTS

| | | | | | |
|---|---|---|---|---|---|
| 4,659,166 | A | * | 4/1987 | Morningstar et al. | 439/580 |
| 4,915,641 | A | * | 4/1990 | Miskin et al. | 439/247 |
| 4,953,929 | A | * | 9/1990 | Basista et al. | 385/55 |
| 4,963,098 | A | * | 10/1990 | Myer et al. | 439/76.1 |
| 4,997,386 | A | * | 3/1991 | Kawachi et al. | 439/352 |
| 5,030,128 | A | * | 7/1991 | Herron et al. | 439/372 |

(Continued)

*Primary Examiner* — Ross Gushi

(74) *Attorney, Agent, or Firm* — Benjamin E. Maskell

(57) ABSTRACT

Disclosed is a device for attaching a plurality of external connectors to an electronic device including a main body, a first plug on the main body positioned to interface with a first port on the electronic device, a slot in the main body for slidably receiving a second external connector and for positioning the second external connector to interface with a second port of the electronic device. The slot has a first opening on a first surface of the main body to receive the second external connector, a second opening on a second surface of the main body to allow a portion of the second external connector to protrude from the second opening of the main body, a first wall opposite the first surface, a rear wall opposite the second surface, a top wall, and a bottom wall.

12 Claims, 12 Drawing Sheets

(56) References Cited

U.S. PATENT DOCUMENTS 5,123,071 A * 6/1992 Mulholland et al. ..... 385/53
5,186,646 A * 2/1993 Pederson ..... 439/374
5,268,982 A * 12/1993 Schaffer et al. ..... 385/86
5,312,268 A * 5/1994 Sumida ..... 439/364
5,326,279 A * 7/1994 Sumida ..... 439/540.1
5,344,347 A * 9/1994 Inoue et al. ..... 439/701
5,378,173 A * 1/1995 Hashizawa ..... 439/701
5,398,295 A * 3/1995 Chang et al. ..... 385/58
5,411,416 A * 5/1995 Balon et al. ..... 439/639
5,454,733 A * 10/1995 Watanabe et al. ..... 439/540.1
5,460,547 A * 10/1995 Belt et al. ..... 439/638
5,545,053 A * 8/1996 Ishii et al. ..... 439/364
5,564,953 A * 10/1996 Endo et al. ..... 439/701
5,569,040 A * 10/1996 Sumida ..... 439/157
5,569,052 A * 10/1996 Belt et al. ..... 439/638
5,574,812 A * 11/1996 Beier et al. ..... 385/78
5,679,028 A * 10/1997 Yagi et al. ..... 439/701
5,725,397 A * 3/1998 Fukamachi et al. ..... 439/701
5,729,478 A * 3/1998 Ma et al. ..... 361/679.41
5,738,537 A * 4/1998 Setoguchi et al. ..... 439/159
5,805,412 A * 9/1998 Yanagisawa et al. .... 361/679.41
5,919,053 A * 7/1999 Tsuji et al. ..... 439/157
5,964,602 A * 10/1999 Aoki et al. ..... 439/157
5,967,808 A * 10/1999 Kubota ..... 439/157
6,010,341 A * 1/2000 Matsuoka ..... 439/76.2
6,045,410 A * 4/2000 Norizuki et al. ..... 439/701
6,046,571 A * 4/2000 Bovio et al. ..... 320/113
6,061,233 A * 5/2000 Jung ..... 361/679.41
6,109,978 A * 8/2000 Stellman et al. ..... 439/701
6,132,246 A * 10/2000 Kodama ..... 439/557
6,151,218 A * 11/2000 Pirdy et al. ..... 361/727
6,152,758 A * 11/2000 Matsuoka ..... 439/364
6,155,884 A * 12/2000 Sugiyama ..... 439/701
6,206,578 B1 * 3/2001 Shin et al. ..... 385/54
6,210,216 B1 * 4/2001 Tso-Chin et al. ..... 439/545
6,305,986 B1 * 10/2001 Hwang ..... 439/607.44
6,321,340 B1 * 11/2001 Shin et al. ..... 713/310
6,352,447 B1 * 3/2002 Ruth ..... 439/540.1
6,409,392 B1 * 6/2002 Lampert et al. ..... 385/56
6,411,503 B1 * 6/2002 Kambayashi et al. ... 361/679.41
6,424,524 B2 * 7/2002 Bovio et al. ..... 361/679.45
6,520,810 B1 * 2/2003 LePottier et al. ..... 439/701
6,547,585 B2 * 4/2003 Bradley et al. ..... 439/353
6,558,201 B1 * 5/2003 Begley et al. ..... 439/638
6,666,715 B2 * 12/2003 Fujita et al. ..... 439/540.1
6,697,892 B1 * 2/2004 Laity et al. ..... 710/72
6,699,074 B1 * 3/2004 Wu et al. ..... 439/607.08
6,722,924 B1 * 4/2004 Zhou et al. ..... 439/607.23
6,724,615 B2 * 4/2004 Kambayashi et al. ..... 361/679.4
6,736,677 B1 * 5/2004 Lin et al. ..... 439/607.28
6,739,889 B1 * 5/2004 Daggett et al. ..... 439/157
6,767,253 B1 * 7/2004 Werner et al. ..... 439/638
6,786,777 B2 * 9/2004 Sakatani ..... 439/677
6,796,844 B1 * 9/2004 Edwards, III ..... 439/638
6,846,200 B1 * 1/2005 Hsu ..... 439/540.1
6,857,900 B2 * 2/2005 Kleeberger et al. ..... 439/540.1
6,887,098 B1 * 5/2005 Luo et al. ..... 439/540.1
6,934,788 B2 * 8/2005 Laity et al. ..... 710/303
6,943,527 B2 * 9/2005 Liu et al. ..... 320/107
7,037,124 B2 * 5/2006 Lee et al. ..... 439/157
7,045,727 B2 * 5/2006 Chiang et al. ..... 200/200
7,108,534 B2 * 9/2006 Fabian ..... 439/284
7,118,414 B2 * 10/2006 Spears et al. ..... 439/540.1
7,140,911 B1 * 11/2006 Rector et al. ..... 439/540.1
7,201,607 B2 * 4/2007 Bernhart et al. ..... 439/532
7,247,032 B2 * 7/2007 Merz ..... 439/76.1
7,303,432 B1 * 12/2007 Chen et al. ..... 439/540.1
7,315,444 B2 * 1/2008 Chen et al. ..... 361/679.55
7,347,744 B2 * 3/2008 Tabata et al. ..... 439/752
7,374,447 B2 * 5/2008 Matsumoto ..... 439/344
7,381,087 B2 * 6/2008 Alvarez ..... 439/540.1
7,390,197 B2 * 6/2008 Merz ..... 439/76.1
7,417,855 B2 * 8/2008 Carnevali ..... 361/679.41
7,500,790 B2 * 3/2009 Erdman et al. ..... 385/75
7,503,802 B2 * 3/2009 Tu et al. ..... 439/540.1
7,503,808 B1 * 3/2009 O'Shea ..... 439/639
7,508,661 B2 * 3/2009 Carnevali ..... 361/679.41
7,554,819 B2 * 6/2009 Chen et al. ..... 361/826
7,641,514 B2 * 1/2010 Chen et al. ..... 439/540.1
7,690,944 B2 * 4/2010 Matsumura et al. ..... 439/578
7,806,722 B2 * 10/2010 Yu et al. ..... 439/540.1
7,857,664 B2 * 12/2010 Waryck et al. ..... 439/638
7,867,040 B2 * 1/2011 Yu et al. ..... 439/701
7,976,346 B2 * 7/2011 Guy et al. ..... 439/638
8,011,961 B2 * 9/2011 Liu et al. ..... 439/607.58
8,105,108 B2 * 1/2012 Vroom et al. ..... 439/540.1
8,118,615 B2 * 2/2012 Peng et al. ..... 439/607.27
8,157,584 B2 * 4/2012 Zhou et al. ..... 439/541.5
8,164,010 B2 * 4/2012 Zhou et al. ..... 200/51.02
8,206,185 B2 * 6/2012 Jehmlich et al. ..... 439/701
8,212,145 B2 * 7/2012 Nagai et al. ..... 174/59
8,221,160 B2 * 7/2012 Liu et al. ..... 439/540.1
8,267,722 B2 * 9/2012 Zhou et al. ..... 439/607.25
8,277,251 B2 * 10/2012 Liu et al. ..... 439/607.04
8,282,414 B2 * 10/2012 Zhou et al. ..... 439/541.5
8,353,724 B2 * 1/2013 Shi et al. ..... 439/625
8,376,761 B2 * 2/2013 Kataoka et al. ..... 439/140
8,419,479 B2 * 4/2013 Vroom et al. ..... 439/639
8,425,247 B2 * 4/2013 Wojcik et al. ..... 439/352
8,430,692 B2 * 4/2013 Peng et al. ..... 439/607.46
8,435,047 B2 * 5/2013 Patel et al. ..... 439/76.1
8,449,337 B2 * 5/2013 Jehmlich et al. ..... 439/701
8,512,076 B2 * 8/2013 Zhang et al. ..... 439/607.23
8,512,079 B2 * 8/2013 Vroom et al. ..... 439/639
8,512,080 B2 * 8/2013 Vroom et al. ..... 439/639
8,562,376 B2 * 10/2013 Chen ..... 439/607.24
2002/0037669 A1 * 3/2002 D'Addario ..... 439/669
2005/0112940 A1 * 5/2005 Naganishi ..... 439/540.1
2005/0164548 A1 * 7/2005 Spears et al. ..... 439/540.1
2005/0168937 A1 * 8/2005 Yin et al. ..... 361/686
2005/0286219 A1 * 12/2005 Kim ..... 361/686
2006/0061964 A1 * 3/2006 Cheng ..... 361/687
2006/0085584 A1 * 4/2006 Chen et al. ..... 710/303
2006/0139875 A1 * 6/2006 Cheng et al. ..... 361/686
2006/0171112 A1 * 8/2006 Lev et al. ..... 361/686
2006/0250767 A1 * 11/2006 Brophy et al. ..... 361/686
2007/0032129 A1 * 2/2007 Kim et al. ..... 439/540.1
2007/0070598 A1 * 3/2007 Chuang ..... 361/686
2008/0214045 A1 * 9/2008 Tu et al. ..... 439/540.1
2009/0269977 A1 * 10/2009 Chen et al. ..... 439/540.1
2009/0311909 A1 * 12/2009 Yu et al. ..... 439/607.23
2010/0068922 A1 * 3/2010 Zhou et al. ..... 439/527
2010/0073862 A1 * 3/2010 Carnevali ..... 361/679.43
2010/0075544 A1 * 3/2010 Liu et al. ..... 439/701
2010/0093219 A1 * 4/2010 Liu et al. ..... 439/607.58
2010/0136825 A1 * 6/2010 Hung et al. ..... 439/540.1
2010/0158297 A1 * 6/2010 Stuczynski ..... 381/332
2010/0195279 A1 * 8/2010 Michael ..... 361/679.41
2010/0206702 A1 * 8/2010 Zhou et al. ..... 200/51.02
2010/0265652 A1 * 10/2010 Agata et al. ..... 361/679.41
2010/0291800 A1 * 11/2010 Liu et al. ..... 439/607.58
2011/0003506 A1 * 1/2011 Zhou et al. ..... 439/540.1
2011/0065314 A1 * 3/2011 Vroom et al. ..... 439/540.1
2011/0111629 A1 * 5/2011 Peng et al. ..... 439/607.35
2011/0134601 A1 * 6/2011 Sa ..... 361/679.43
2011/0237120 A1 * 9/2011 Zhong et al. ..... 439/540.1
2011/0242754 A1 * 10/2011 Morton ..... 361/679.41
2011/0279966 A1 * 11/2011 Sayavong ..... 361/679.43
2012/0094527 A1 * 4/2012 Vroom et al. ..... 439/540.1
2012/0094528 A1 * 4/2012 Vroom et al. ..... 439/540.1
2012/0162902 A1 * 6/2012 Zhou et al. ..... 361/679.41
2012/0190235 A1 * 7/2012 Sakurai ..... 439/540.1
2012/0322301 A1 * 12/2012 Chen et al. ..... 439/540.1
2013/0137297 A1 * 5/2013 Vroom ..... 439/540.1
2013/0137298 A1 * 5/2013 Vroom et al. ..... 439/540.1
2013/0164973 A1 * 6/2013 Ngo ..... 439/540.1
2013/0303012 A1 * 11/2013 Vroom et al. ..... 439/345

* cited by examiner

DOCKING STATION FOR AN ELECTRONIC DEVICE WITH IMPROVED ELECTRICAL INTERFACE

This application is a continuation of U.S. application Ser. No. 13/945,855 filed Jul. 18, 2013, which is a divisional of U.S. application Ser. No. 13/306,960 filed Nov. 29, 2011, now U.S. Pat. No. 8,512,079 which is a continuation of U.S. application Ser. No. 13/306,956 filed Nov. 29, 2011, now U.S. Pat. No. 8,419,479 which is a continuation-in-part of U.S. application Ser. No. 12/562,121 filed Sep. 17, 2009, now U.S. Pat. No. 8,105,108. All of the aforementioned patents and applications are hereby incorporated by reference.

BACKGROUND OF THE INVENTION

1. Field of the Invention

The embodiments of the invention relate to a docking station for an electronic device, and more particularly, to a docking station for laptop computers. Although embodiments of the invention are suitable for a wide scope of applications, it is particularly suitable for facilitating the rapid connection of external devices to a laptop computer.

2. Discussion of the Related Art

A docking station for electronic devices refers to a peripheral which facilitates the connection of external connectors to a portable device. Such docking stations usually contain electronic connectors integrated into the body of the docking station that mate with the ports on the docked device. Output ports on the main body of the docking station essentially replicate the ports on the electronic device. The user can then attach connectors for external devices to the output ports of the docking station. Such docking stations are useful because they facilitate the easy insertion and removal of an electronic device without the need to individually connect and disconnect cables for external devices.

Despite the time-saving efficiencies of prior art docking stations, certain plugs and connectors can be expensive and mechanically complicated thereby increasing the materials costs and manufacturing labor costs. Additionally, certain proprietary connectors, by virtue of manufacturer's patent rights, cannot be manufactured without a license.

SUMMARY OF THE INVENTION

Accordingly, embodiments of the invention are directed to a docking station for portable electronics with an improved electrical interface that substantially obviates one or more of the problems due to limitations and disadvantages of the related art.

An object of embodiments of the invention is to provide a docking station with spring pins to interface with certain expensive or proprietary connectors.

Another object of embodiments of the invention is to provide an improved retention mechanism for certain expensive or proprietary connectors.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments f the invention, as embodied and broadly described, the docking station for an electronic device with improved electrical interface includes a main body, a plurality of ports on the main body, a plurality of plugs protruding from the main body, the plurality of plugs positioned to interface with the electronic device, a plurality of pins protruding from the main body, a first pin of the plurality of pins positioned to interface with a first contact of a port of the electronic device, a second pin of the plurality of pins positioned to interface with a second contact of the port of the electronic device.

In another aspect, a docking station for electronic device with an improved electrical interface includes a main body, a first port on the main body for attaching a first external connector, a second port on the main body for attaching a second external connector, a first plug on the main body positioned to interface with a first port on the electronic device, a second plug on the main body positioned to interface with a second port on the electronic device, a first pin on the main body positioned to interface with a first electrical contact of a third port of the electronic device, and a second pin on he main body positioned to interface with a second electrical contact of the third port of the electronic device.

In yet another aspect, a docking station for an electronic device having an improved electrical interface includes a main body, a data plug protruding from the main body, the plug positioned to interface with the electronic device, a data port on the main body electrically connected to the data plug, a plurality of pins protruding from the main body, a first pin of the plurality of pins positioned to interface with a first contact of a port of the electronic device, a second pin of the plurality of pins positioned to interface with a second contact of the port of the electronic device, and a power port on the main body electrically connected to the first pin and the second pin.

In another aspect, a docking station for an electronic device having an improved electrical interface includes a main body, a first port on the main body for accepting a first external connector, a second port on the main body for accepting a second external connector, a first plug on the main body positioned to interface with a first port on the electronic device, a second plug on the main body positioned to interface with a second port on the electronic device, an adapter piece for accepting and retaining a third external connector, a slot in the main body for receiving the adapter piece and for positioning the third external connector to interface with a third port of the electronic device, and a retention mechanism in the main body for retaining the adapter piece.

In yet another aspect, a docking station for an electronic device having an improved electrical interface includes a main body, a first port on the main body for accepting a first external connector, a second port on the main body for accepting a second external connector, a first plug on the main body positioned to interface with a first port on the electronic device, a second plug on the main body positioned to interface with a second port on the electronic device, a slot in the main body for slidably receiving a third external connector and for positioning the third external connector to interface with a third port of the electronic device, and a retention mechanism in the main body for retaining the third external connector.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
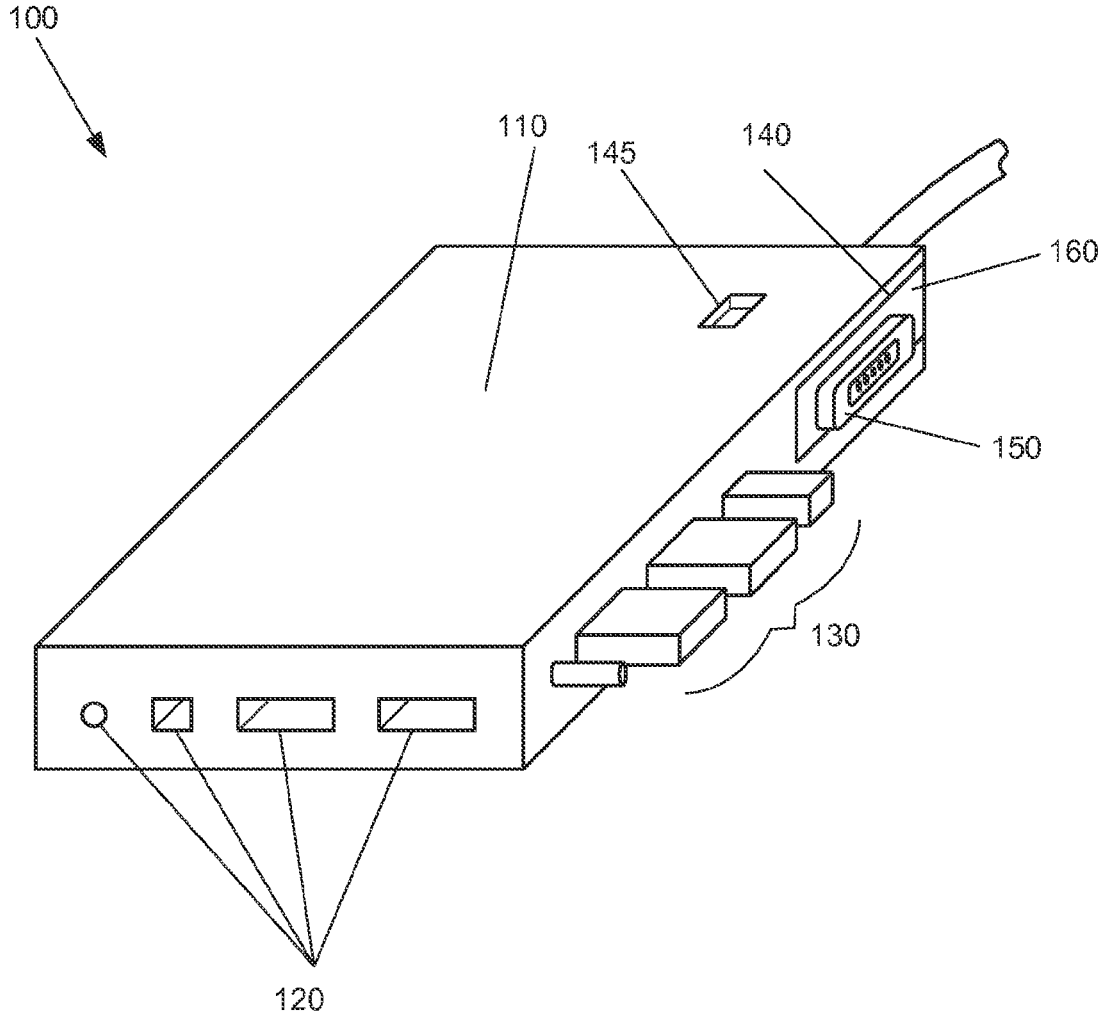
FIG. 1 is an isometric view of a docking station for an electronic device.
Figure 2A:
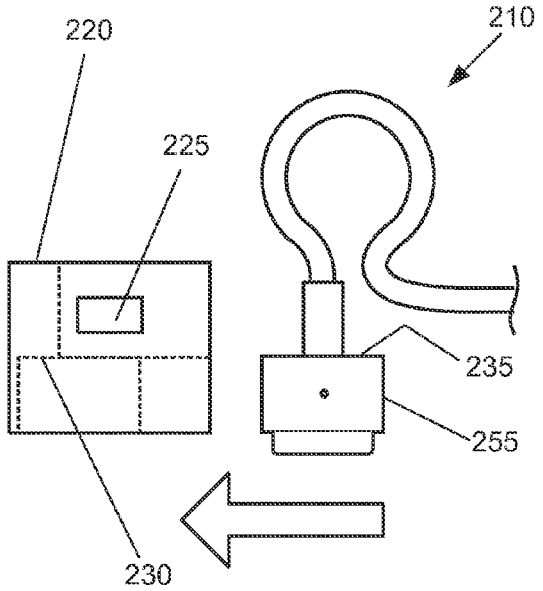
FIGS. 2A-2D are assembly views of an external connector and a chicklet.
Figure 2C:
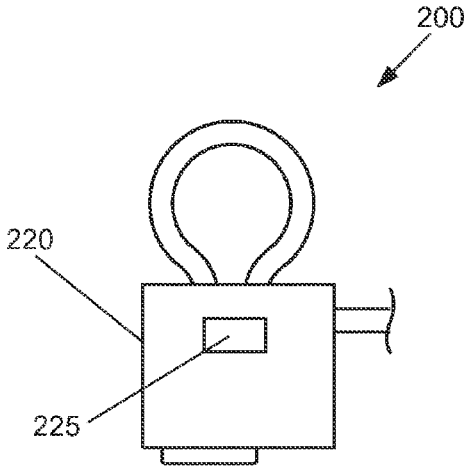
Figure 2B:
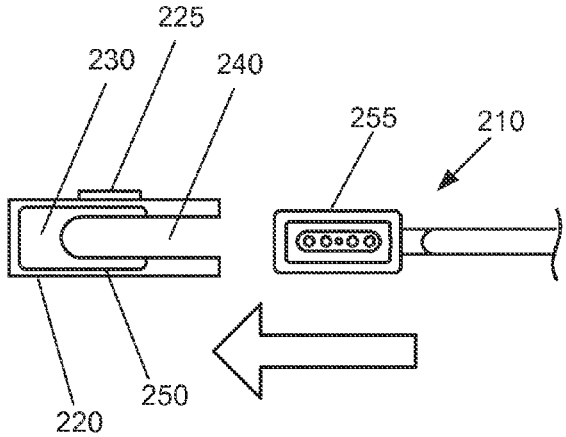
Figure 2D:
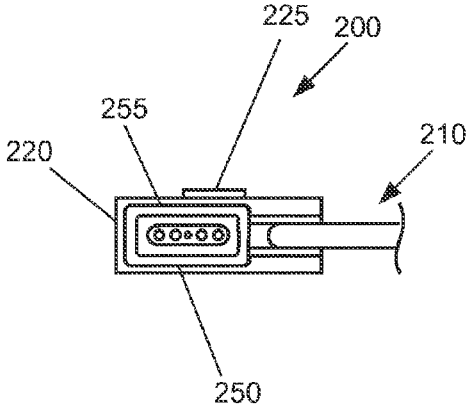

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled the art. In the drawings, the thicknesses of layers and regions are exaggerated for clarity. Like reference numerals in the drawings denote like elements.

FIG. 1 is an isometric view of a docking station for an electronic device. As shown in FIG. 1, a docking station 100 for an electronic device includes a main body 110, a plurality of ports 120 on the main body, and a plurality of plugs 130 protruding from the main body. The main body 110 also includes a slot 140 for retaining for retaining an external connector 150. The external connector 150 can be enclosed in a shroud called a chicklet 160. The external dimensions of the chicklet 160 are sized to easily slide into the slot 140. The internal dimensions of the chicklet 160 are sized to match the dimensions of the external connector 150. The slot 140 shown in FIG. 1 has openings on the rear face and right face of the main body 110 of the docking station. However, "slot" can be construed broadly to include any opening in the main body 110 of the docking station 100 sufficient to receive the chicklet 160.

In comparison to the docking station 100, the chicklet 160 is relatively inexpensive. In a retail environment, the docking station 100 can come with a variety of chicklets (not shown). The chicklets can have different internal dimensions to match a variety of potential external connectors. In this way, product configurations can be simplified by providing a docking station which can be easily adapted to be compatible with a variety of external connectors simply by using an inexpensive chicklet.

The chicklet 160 can have a protrusion (not shown) which engages a cutout 170 on the main body 110 of the docking station 100. When the protrusion (not shown) engages the cutout 145, the chicklet is locked in place. In an alternative embodiment, the cutout 145 can be formed as a depression on the interior of the slot 140.

FIGS. 2A-2D are assembly views of an external connector and a chicklet. As shown in FIGS. 2A-2D, the assembly 200 includes an external connector 210 and a chicklet 220. The external connector 210 can be a rectangular-style, first-generation, MagSafe adapter compatible with certain Apple computers. The internal dimensions of the chicklet 220 are sized to receive and retain a specific external connector 210. The external dimensions of the chicklet 220 are sized to be compatible with a docking station (not shown). The chicklet 220 can include an interior rear wall 230 which supports a rear face 235 of the external connector 210. The rear wall 230 can maintain the external connector 210 at a desired depth in the chicklet 220. The chicklet 220 can also include interior side walls 250 which can support a side face 255 of the external connector 210. The side walls 250 can maintain the external connector 210 at a desired horizontal and vertical orientation in the chicklet 220.

The chicklet 220 can have a protrusion 225 which engages a matched cutout (not shown) of a docking station. When the protrusion 225 engages the cutout, the chicklet is locked in place.

The chicklet 220 can also include a slot 240. The slot 240 can allow passage for the cable of an external connector 210 so that the external connector 210 can be introduced into the chicklet and be held in place by the interior rear 230 and side wails 250. The slot 240 can also allow the chicklet 220 to expand slightly thereby facilitating the introduction of an external connector 210 into the chicklet 220.

Figure 3A:
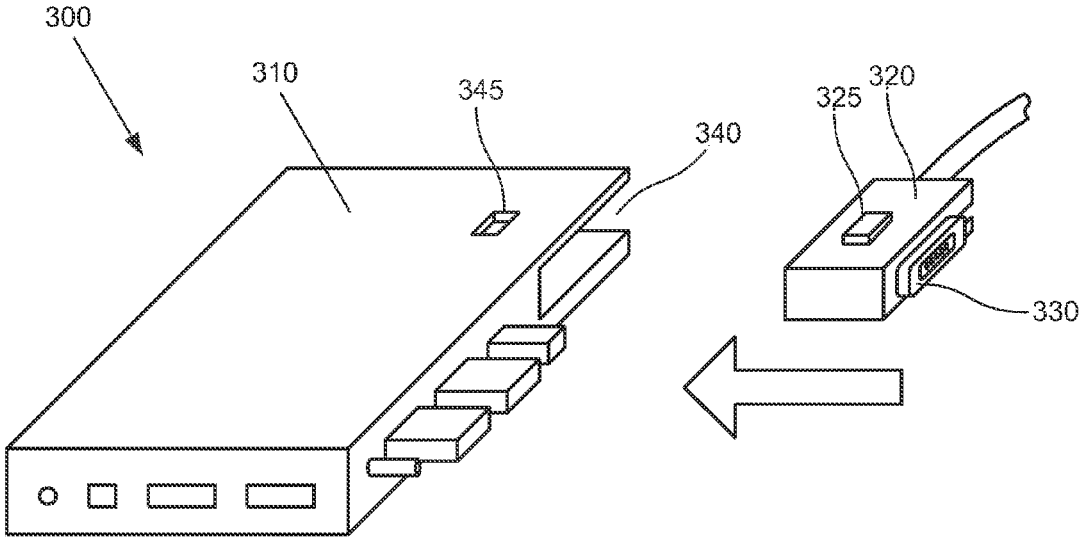
FIG. 3A is an assembly view of docking station and chicklet.

FIG. 3A is an assembly view of docking station and chicklet. As shown in FIG. 3, the assembly includes a docking station 300 having a main body 310, a chicklet 320, and an external connector 330. The docking station 310 includes a slot 340 which is sized to receive and retain the chicklet 320. The external connector 330 is partially enclosed in the chicklet 320. The chicklet 320 includes a raised locking portion 325. The main body 310 of the docking station 300 includes a recess 345. The chicklet 320 can be introduced into the slot 340 in the docking station 310. The walls of the slot 340 can retain the exterior walls of the chicklet 320 and can prevent the chicklet 320 from expanding along the slot (FIG. 2, 240) in the chicklet thereby securing the external connector 330 in the chicklet 320. The raised locking portion 325 of the chicklet 320 engages the recess 345 of the slot 340 thereby securing the chicklet 320 in the slot 340.

Figure 3B:
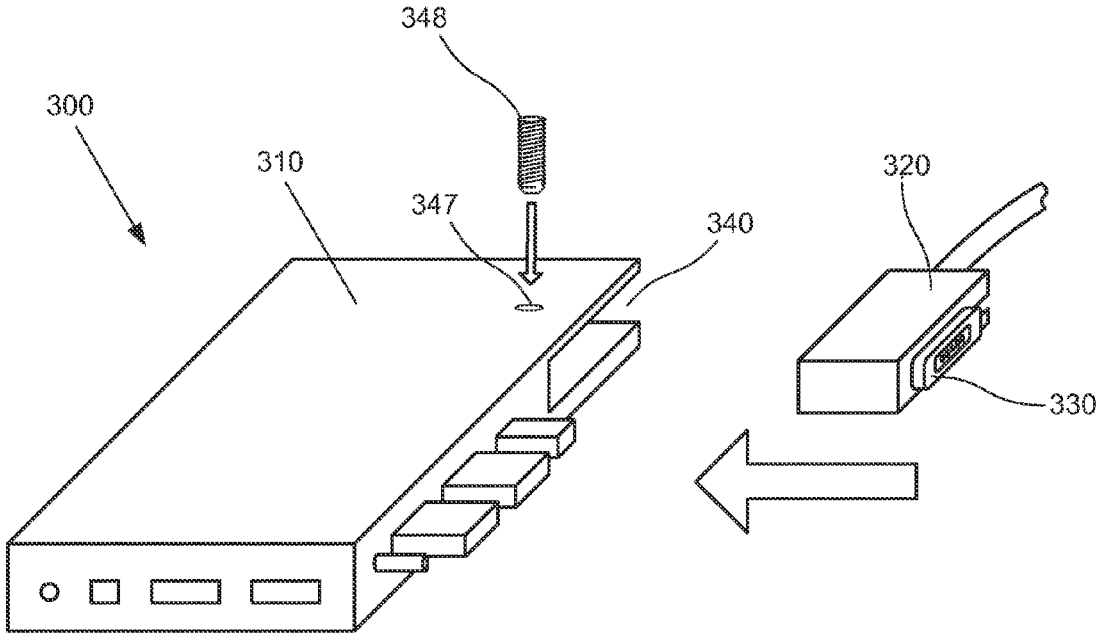
FIG. 3B is an assembly view of docking station and chicklet.

FIG. 3B is an assembly view of docking station and chicklet. As shown in FIG. 3, the assembly includes a docking station 300 having a main body 310, a chicklet 320, and an external connector 330. The docking station 310 includes a slot 340 which is sized to receive and retain the chicklet 320. The external connector 330 is partially enclosed in the chicklet 320. The main body 310 of the docking station 300 includes a hole 347 which extends through to the slot 340 and is sized to receive a setscrew 348. The chicklet 320 can be introduced into the slot 340 in the docking station 310. The walls of the slot 340 can retain the exterior walls of the chicklet 320 and can prevent the chicklet 320 from expanding along the slot (FIG. 2, 240) in the chicklet thereby securing the external connector 330 in the chicklet 320. After the chicklet 320 is inserted into the slot 340, the setscrew 348 can be introduced and tightened in the hole 347. The set screw 348 can engage the chicklet and secure the chicklet 320 into the slot 340.

Figure 4:
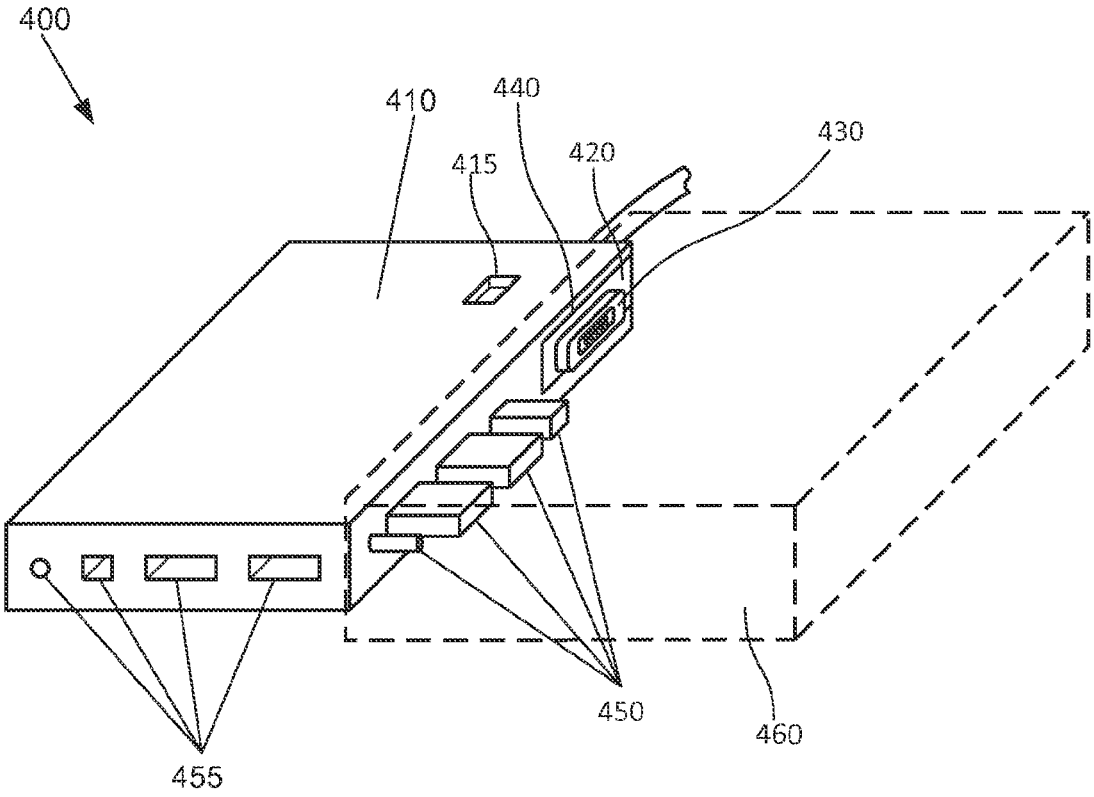
FIG. 4 is an isometric view of a docking station for an electronic device.

FIG. 4 is an isometric view of a docking station for an electronic device. As shown in FIG. 4, the docking station 400 includes a main body 410, a chicklet 420 which holds an external connector 430, a plurality of ports 455, and a plurality of plugs 450. The chicklet 420 can be positioned in a slot 440 in the main body 410 of the dock 400. The chicklet 420 can include a raised portion (not shown) on the body of the chicklet. The raised portion (not shown) of the chicklet 420 can engage a depression 415 in the main body 410 of the docking station 400. The plurality of plugs 450 can be positioned in the main body 410 of the docking station 400 so as to correspond to the locations of a plurality of ports (not shown) on an electronic device 460.

Figure 5A:
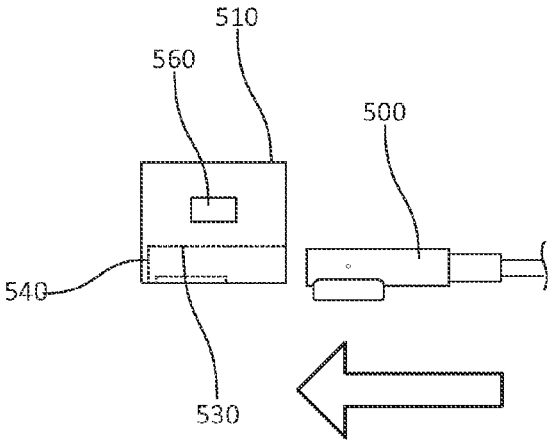
FIGS. 5A-5D are assembly views of a chicklet and external connector according to an exemplary embodiment of the invention.
Figure 5C:
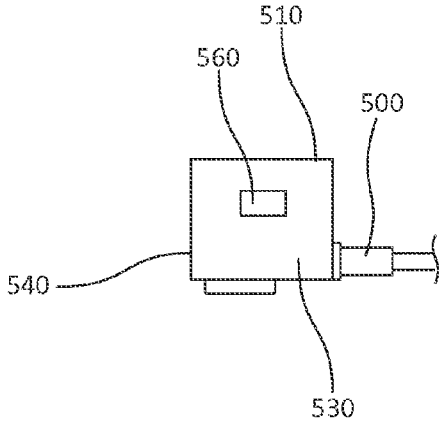
Figure 5B:
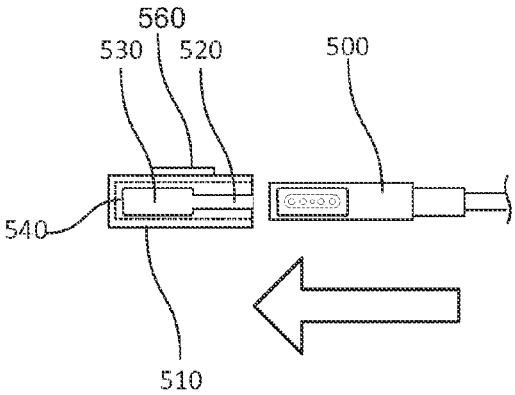
Figure 5D:
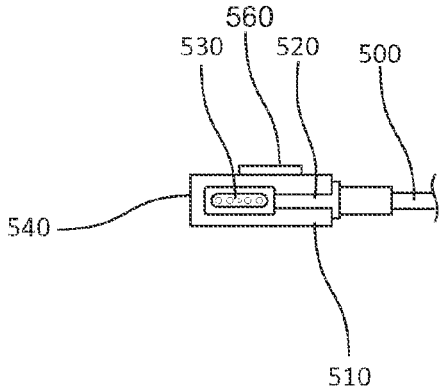

FIGS. 5A-5D are assembly views of a chicklet and external connector according to an exemplary embodiment of the invention. As shown in FIGS. 5A-5D an external connector 500 can be inserted into a chicklet 510. The external connector 500 can be a barrel-style MagSafe adapter compatible with certain Apple branded computers. The chicklet 510 can include a slot 520, a rear wall 530, and side walls 540. The slot 520 can allow the chicklet 510 to deflect temporarily to facilitate the insertion of the external connector 500 into the chicklet 510. Once inserted into the chicklet 510, the rear wall 530 can prevent the external connector 500 from being pushed too deeply into the chicklet 510. The rear watt 530 can be positioned so as to hold the external connector 500 at a depth where the plug-portion of the external connector 500 protrudes from the chicklet 510. Referring to FIG. 5B, the side walls 540 of the chicklet 510 can secure the external connector 500 from horizontal and vertical movement. The chicklet 510 can include a raised portion 560 which can serve as a locking portion when inserted into a receiving slot of a docking station (not shown).

Figure 6A:
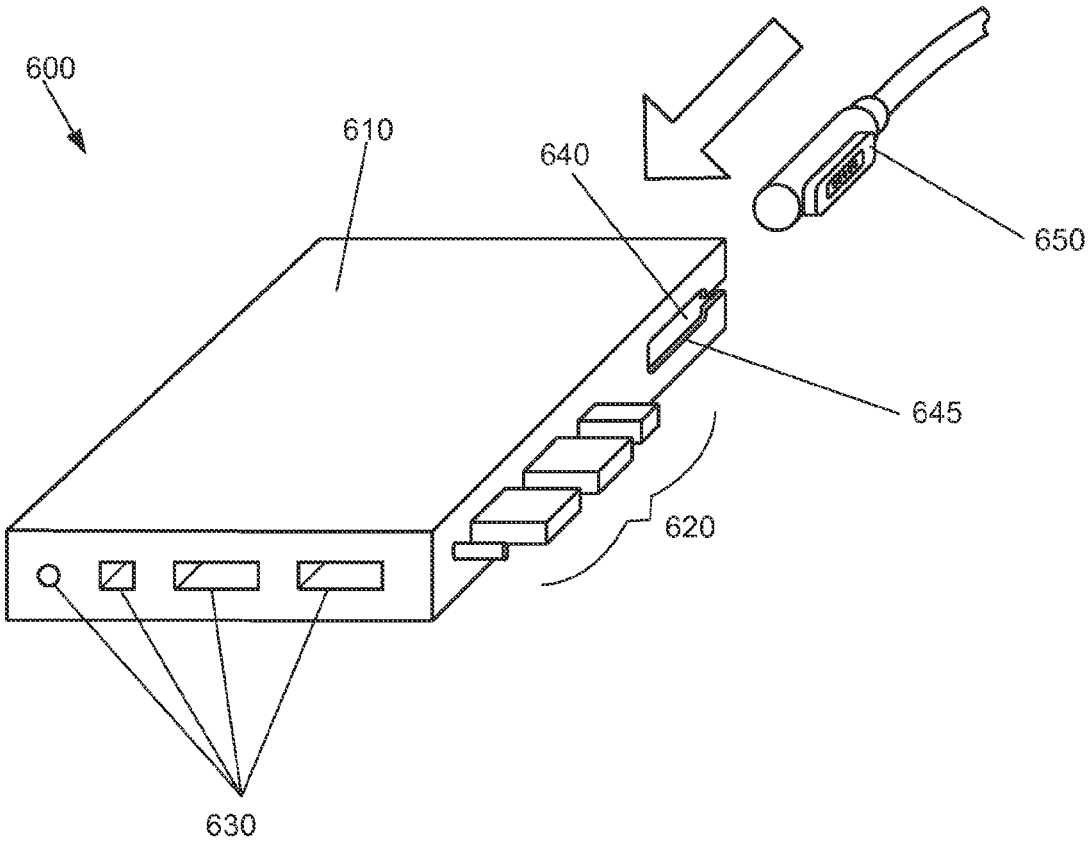
FIGS. 6A-6C are isometric views of a docking station according to an exemplary embodiment of the invention.
Figure 6B:
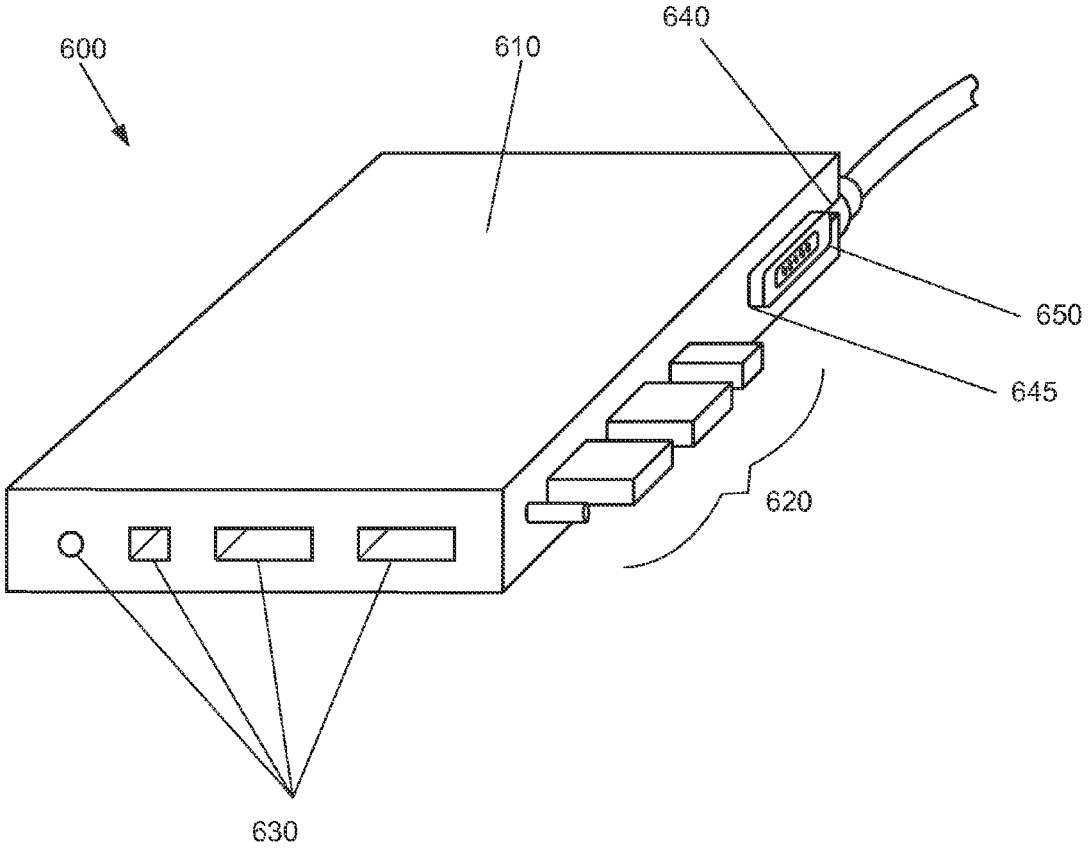
Figure 6C:
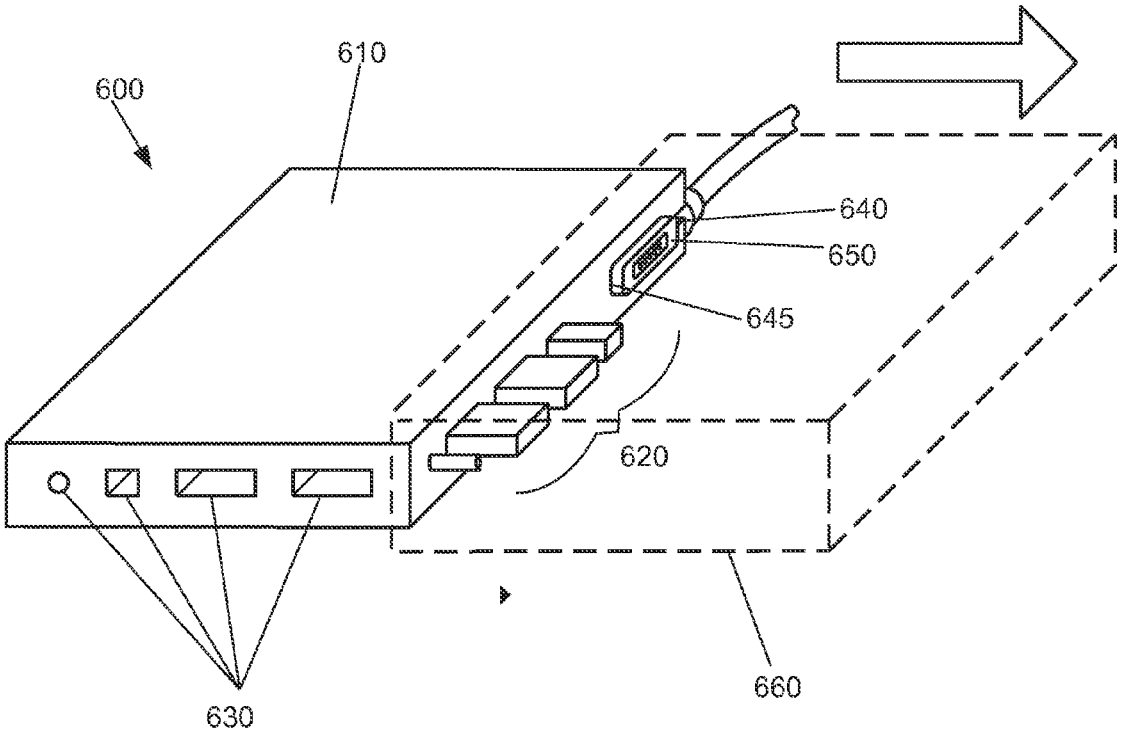

FIGS. 6A-6C are isometric views of a docking station according to an exemplary embodiment of the invention. As shown in FIGS. 6A-6C, a docking station 600 includes a main body 610, a plurality of plugs 620, and a plurality of ports 630. The docking station can include a slot 640 sized to accept an external connector 650. Referring to FIG. 6A, the external connector 650 can be introduced into the slot 640. The slot 640 can deflect slightly to facilitate entry of the external connector 650. The slot 640, can have a real wall (not shown) and side walls 645 which secure the external connector 650. Referring to FIG. 6C, the plurality of plugs 620 and the slot 640 holding the external connector 650 can be positioned within the main body 610 to correspond to the ports (not shown) of an electronic device 660.

Figure 7:
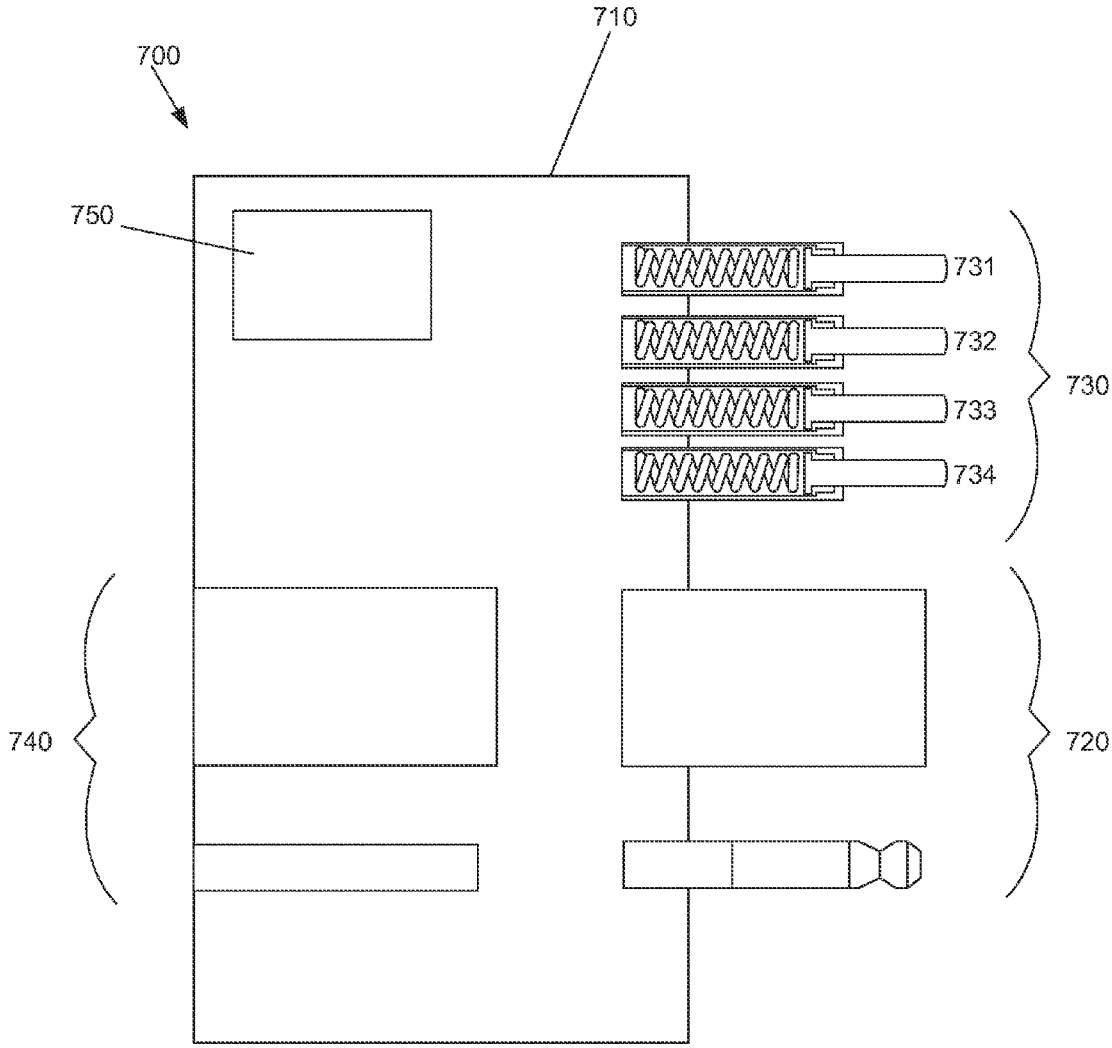
FIG. 7 is a top cross-sectional view of a docking station according to an exemplary embodiment of the invention.

FIG. 7 is atop cross-sectional view of a docking station according to an exemplary embodiment of the invention. As shown in FIG. 7, a docking station 700 includes a main body 710, a plurality of plugs 720, a plurality of spring pins 730, and a plurality of ports 740. The plurality of plugs 720 can be positioned within the main body 710 to match the location of ports on an electronic device (not shown). The spring pins 730 can be positioned to match the location of specific pins of a port on the electronic device (not shown). The docking station 700 can include an AC/DC converter 750 for converting AC power to DC power for use by the docking station 700 or the electronic device (not shown). The docking station 700 can be powered by an external DC power supply (not shown). The AC/DC converter 750 can include a circuit to monitor the charging status of the batteries in the electronic device.

It is not necessary for each of the plurality of spring pins to correspond to a pin on a port of the electronic device. According to embodiments of the invention, there are fewer spring pins on the dock than there are pins of a port on the electronic device. In embodiments of the invention, multiple spring pins connect to pins in separate ports of an electronic device.

In an exemplary embodiment of the invention, there can be four or five spring pins. These pins can correspond in location to the pins of a power port on an electronic device. The power port on the electronic device can be designed to accept a proprietary power plug. The power port can have electrical contacts for sending and receiving electrical signals. In embodiments of the invention the port on the electronic device can be a MagSafe power port. The spring pins on the docking station can be positioned to connect to the electrical contacts of a power port on the electronic device such as the electrical contacts of a MagSafe power port. The spring pins 731-734 can be electrically connected to the AC/DC converter 750. DC power can be provided through pins 731 and 734. A charge monitoring circuit can be connected to spring pins 732 and 733. When an electronic device (not show is abutted to the spring pins 731-734, the spring pins 731-734 can electrically interface with the contacts of a port on the electronic device (not shown). The spring pins can compress slightly to create a reliable electrical connection. In use, AC electrical power can be applied to the AC/DC converter 750. DC power from the AC/DC converter 750 can be applied to the plurality of spring pins 730 to provide DC power to a connected electronic device (not shown).

Figure 8:
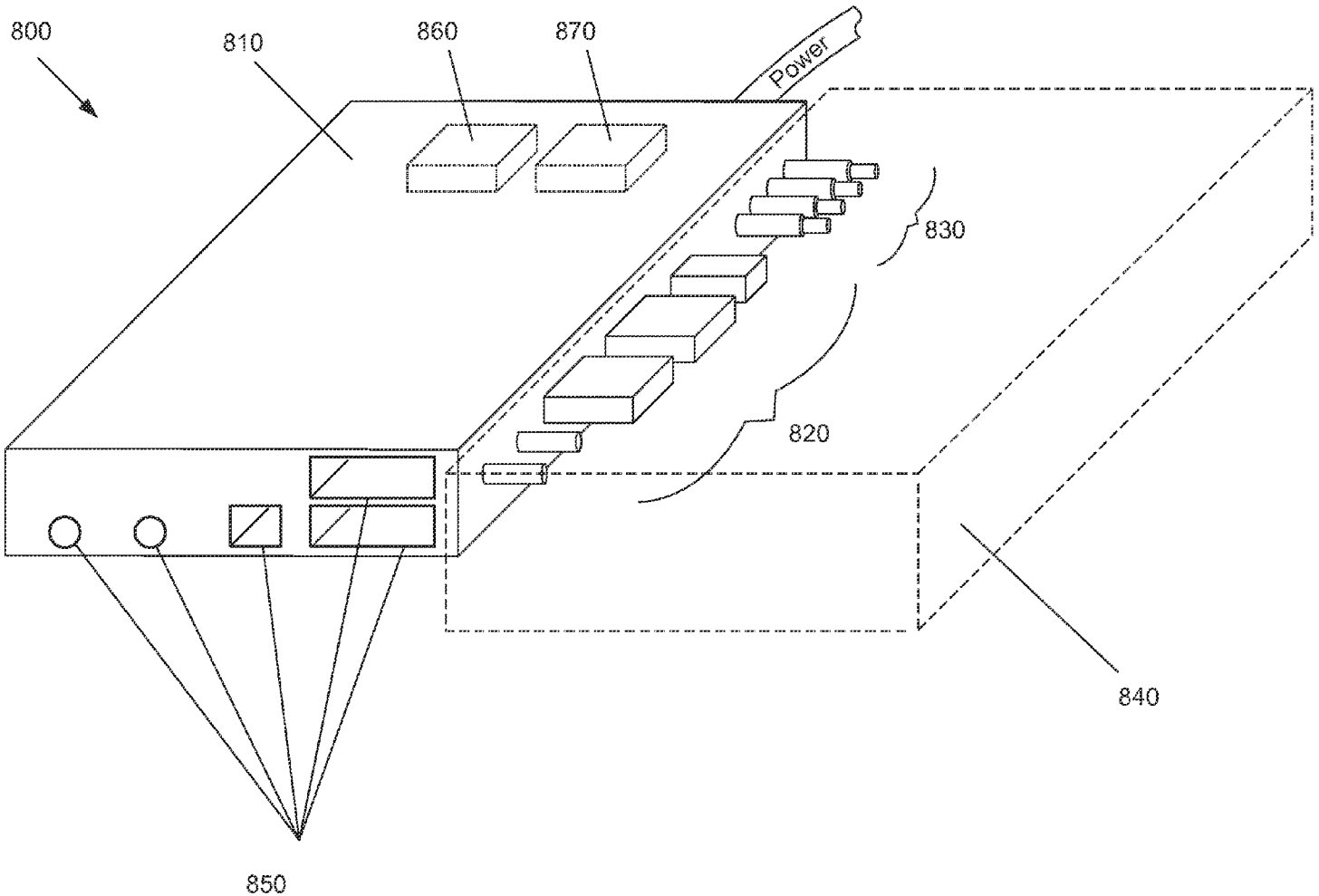
FIG. 8 is an isometric assembly view of a docking station and an electronic device.

FIG. 8 is an isometric assembly view of a docking station and an electronic device. As shown in FIG. 8, the docking station 800 includes a main body 810, a plurality of plugs 820, and a plurality of spring pins 830. The main body 810 can also include a plurality of ports 850 for connecting peripheral devices. The positioning of the plurality of plugs 820 can correspond to a positioning of a plurality of ports (not shown) on the electronic device 840. The position of the plurality of spring pins 830 corresponds to the position of a plurality of contacts (not shown) of a poi (not shown) on the electronic device 840. When docking station 800 and the electronic device 840 are pressed together, the plurality of plugs 820 on the main body 810 of the docking station 800 can interface with the plurality of ports (not shown) on the electronic device 840. Similarly, when the docking station 800 and the electronic device 840 are pressed together, the plurality of spring pins 830 on the main body 810 of the docking station 800 can interface with contacts (not shown) of a port (not shown) on the electronic device 840.

Some electrical connectors or ports on an electronic device such as the electronic device 840 do not exert sufficient friction on a plug to hold the plug in place with friction alone. Some such plugs, such as the Apple MagSafe adapter, rely on magnetic forces rather than friction to hold a plug in contact with a port on the electronic device. It can be costly to produce these proprietary ports and connectors as companies owning rights to such a design may demand prohibitively high licensing fees to allow third parties o manufacture the port or connector. Accordingly, in exemplary embodiments of the invention the necessary electrical contacts of a third-party proprietary connector are provided as spring pins and the proprietary body and magnetic features of the connector are omitted. When an electronic device is interfaced with the docking station, the spring pins compress slightly and press back on predetermined contacts of a port on the electronic device. The assembly can be held in place by the friction force created by adjacent plugs pressed into ports. Alternatively, the assembly can be held in place by mounting the docking station to a base member having a retention mechanism (not shown) for the electronic device. Alternatively, the assembly can be held in place by gravity using the weight of the electronic device to press down against the plurality of plugs and plurality of spring pins. In a gravity-coupling system, the electronic device and corresponding electrical contacts can be positioned above the plurality of spring pins. The weight of the electronic device provides the force to keep the electrical contacts and the spring pins joined.

The plurality of plugs 820 on the main body 810 of the docking station 800 can be electrically connected to a plurality of ports 850 on the also on the main body 810 of the docking station 800. The plugs 820 and ports 850 can be one-to-one correspondence where each port is electrically connected to one and only one plug in a pass-through configuration. When an electronic device 840 is introduced into the docking station 800, the each of the plurality of ports 850 is connected through the plurality of plugs 820 to individual ports (not shown) on the electronic device 840. The electrical connections between the docking station 800 and the electronic device 840 can be severed in a single motion by separating the electronic device 840 from the docking station 800. Similarly, electrical connections can be formed between the docking station 800 and the electronic device 840 in a single motion. A user may connect a plug (not shown) from a variety of peripheral devices (not shown) to the plugs 850 which will electrically connect through the docking station 800 to the electronic device 840. This saves a user the hassle and time of individually positioning and inserting each of the plugs (not shown) from the peripheral devices (not shown) into the electronic device 840.

In other exemplary embodiments of the invention, there is not a one-to-one correspondence between the plurality of plugs 820 and the plurality of ports 850. In such a configuration, there may be a one-to-many setup where one of the plurality of plugs 820 corresponds to many of the plurality of ports 850. In exemplary embodiments the main body 810 can have an embedded USB hub 860. One of the plurality of plugs 820 can be a USB plug connected to an embedded USB hub 860. The embedded USB hub 860 can provide multiple USB ports such as some of the plurality of ports 850 on the main body 810 of the docking station 800.

The docking station 800 can include an embedded USB audio device 870. The USB audio device 860 can connect to the electronic device through a USB plug which can be one of the plurality of plugs 820. The USB audio device 870 can connect to an embedded USB hub 860 as described in the preceding paragraph. The USB audio device can provide an ⅛" audio port on the main body 810 of the docking station 800. The ⅛" audio port can be one of the plurality of ports 850. Such a configuration is desirable as it obviates the need for the docking station 800 to provide a plug to interface with un audio port of the electronic device. The benefits are twofold in that the act of docking and undocking the electronic device is easier because there is less friction by way of few connectors. Second, on many electronic devices, there is an internal switch which disables audio through speakers embedded in the device when an external audio connector is introduced into the electronic device. By using a USB audio device 870 embedded in the docking station 800, a user can use a software program to select an appropriate audio device (embedded speakers or external audio).

Embodiments of the invention have been described as having a plurality of ports and a plurality of plugs positioned to match the location and orientation of a plurality of ports on an electronic device. The selection of the individual plugs which form the plurality of plugs can be dependent on the electronic device for which the docking station is designed. Similarly, the position and orientation of the plurality of plugs in the docking station can be dependent on the electronic device with which a docking station is designed to work. It is not essential to provide a plug for each port on the electronic device. In embodiments of the invention, fewer plugs are provided than ports on an electronic device. Similarly, the plurality of ports 850 on the docking station 800 is not dependent on the plurality of plugs 820 or the ports on the electronic device 840. There can be more ports 850 on the docking station 800 than there are plugs 820 on the docking station 800. The docking station 800 can include embedded devices such as a USB hub 860, an audio device 870, video devices, network devices, storage and other devices which operate on USB, Firewire, Thunderbolt, Ethernet, or other general purpose I/O technology.

Figure 9:
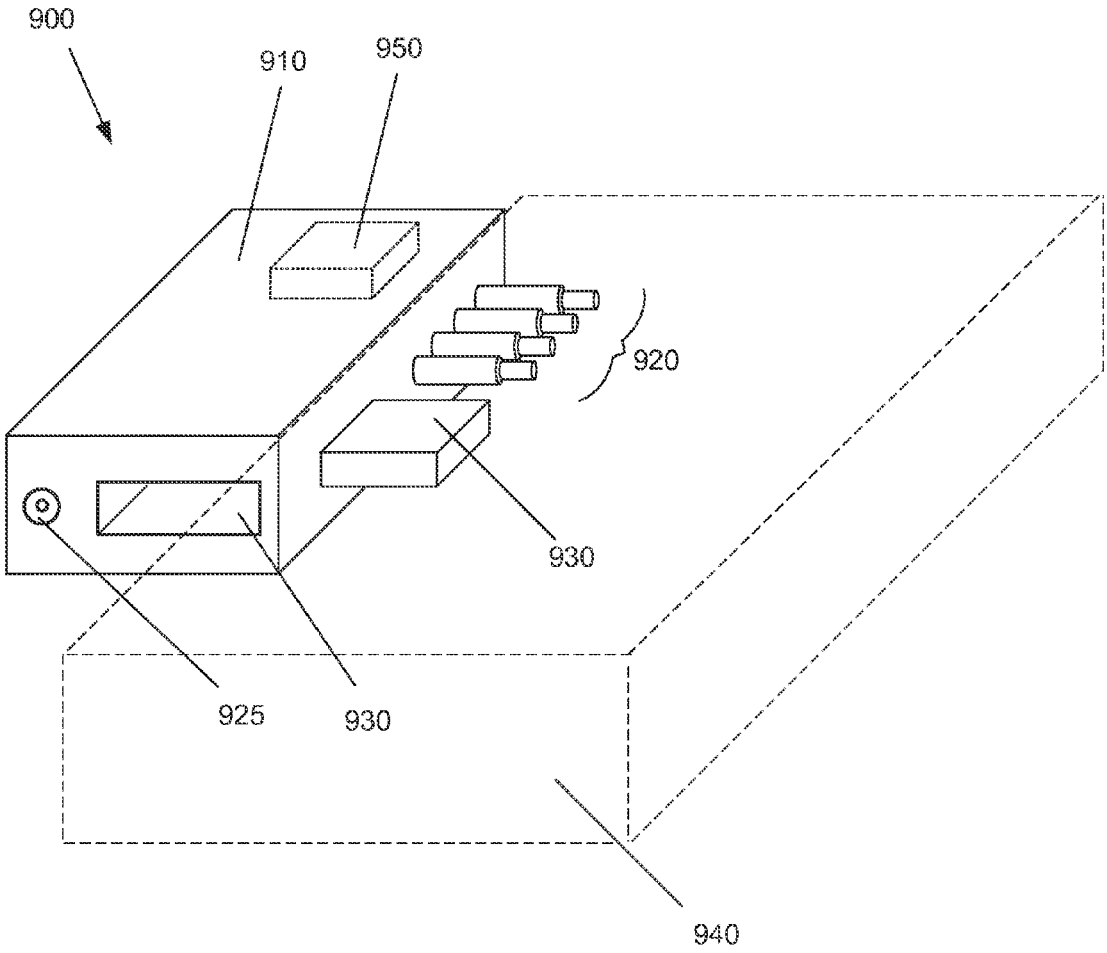
FIG. 9 is an isometric view of docking station according to exemplary embodiment of the invention.

FIG. 9 is an isometric view of docking station according to exemplary embodiment of the invention. As shown in FIG. 9, the docking station 900 includes a main body 910 a plurality of spring pins 920 and a plug 930. The spring pins 920 are positioned to match the location of electrical contacts (not shown) on an electronic device 940. The plug is positioned to match the location of port (not shown) on the electronic device 940. When the plug 930 is introduced into the electronic device 940 friction can hold the plug 930 in connection with the electronic device. In embodiments of the invention, the spring pins 920 and mating electrical contacts (not shown) of the electronic device 940 cannot a one maintain secure electrical contact. Instead, the spring pins 920 can rely on the friction connection between the plug 930 and a port (not shown) on the electronic device 940 to maintain proximity to the electronic device and secure electrical connection. In embodiments of the invention the plug 930 can include a locking tab (not shown), such as the tab on an Ethernet plug, to maintain electrical connection with the electronic device 940.

Inside the docking station 900, the plurality of spring pins 920 can be electrically connected to an external port 925. The port 925 can accept AC or DC power. The docking station can include an internal AC/DC adapter 950 to accept AC power from port 925 and provide DC power to the spring pins 920. The AC/DC adapter 950 can also include a charge monitoring circuit. The plug 930 can be electrically connected to the port 935. The electrical connection can be a pure pass-through where the docking station 900 does not have internal electronics which manipulate the electrical signal.

While embodiments of the invention have been shown and described as having a single block comprising a plurality of plugs, it is contemplated that the invention may also be embodied as two or more blocks comprising one or more plugs. These blocks can be mounted on a chassis including a lever system or electromechanical actuators which can engage and disengage the blocks. Accordingly, this invention is not limited to the illustrated embodiments but also covers embodiments having multiple blocks of one or more plugs. Such a configuration can be useful for interfacing with at electronic device which has connectors on one or more sides.

It will be apparent to those skilled in the art that various modifications and variations can be made in the docking station for an electronic device having an improved electrical interface without departing from the spirit or scope of the invention. Thus, it is intended that embodiments of the invention cover the modifications and variations of this invention provided they come within the scope of the appended claims and their equivalents.

What is claimed is:

1. A device for attaching a plurality of external connectors to an electronic device, comprising:

a main body;

a first plug on the main body positioned to interface with a first port on the electronic device;

second plug on the main body positioned to interface with a second port on the electronic device;

a slot in the main body for slidably receiving a third external connector and for positioning the third external connector to interface with a third port of the electronic device, the slot having:

a first opening on a first surface of the main body to receive the third external connector;

a second opening on a second surface of the main body to allow a portion of the third external connector to protrude from the second opening of the main body; and a retention mechanism in the main body for retaining the third external connector, the retention mechanism having:

a first wall opposite the first surface;

a rear wall opposite the second surface;

a top wall; and a bottom wall.

2. The device of claim 1 wherein the retention mechanism is a side wall of the slot.

3. The device of claim 1 wherein the main body deforms along the slot to receive and retain the third external connector.

4. The device of claim 1 wherein the first opening is smaller than the second opening.

5. The device of claim 1 wherein the first opening is larger than the second opening.

6. The device of claim 1 wherein the first opening is perpendicular to the second opening.

7. The device of claim 1 wherein first surface is perpendicular to the second surface.

8. The device of claim 1 wherein the third external connector is for providing power to the electronic device.

9. A device for attaching a plurality of external connectors to an electronic device, comprising:

a main body;

a first plug on the main body positioned to interface with a first port on the electronic device;

a slot in the main body for slidably receiving an external connector and for positioning the external connector to interface with a second port of the electronic device, the slot having:

a first opening on a first surface of the main body to receive the external connector;

a second opening on a second surface of the main body to allow a portion of the external connector to protrude from the second opening of the main body;

a first wall opposite the first surface;

a rear wall opposite the second surface, the rear wall positioned to support the external connector;

a top wall;

a bottom wall; and wherein the main body deforms along the slot to receive and retain the external connector.

10. A docking station for attaching a plurality of external connectors to an electronic device, comprising:

a main body;

a first plug on the main body positioned to interface with a first port on the electronic device;

a first port of the docking station for accepting a first external connector;

a slot in the main body for slidably receiving a second external connector and for positioning the second external connector to interface with a second port of the electronic device, the slot having:

a first opening on a first surface of the main body to receive the second external connector;

a second opening on a second surface of the main body to allow a portion of the second external connector to protrude from the second opening of the main body;

a first wall opposite the first surface;

a rear wall opposite the second surface, the rear wall positioned to support the second external connector;

a top wall; and a bottom wall.

11. The docking station of claim 10 further comprising a second plug on the main body positioned to interface with a third port on the electronic device.

12. The device of claim 11 wherein the first port of the docking station is electrically connected to the first plug on the main body.

* * * * *